US005269415A

United States Patent [19]

Wenschhof et al.

[11] Patent Number: 5,269,415

[45] Date of Patent: Dec. 14, 1993

[54] RACK FOR SUPPORTING ROLLS OF WEB MATERIAL PLUS APPARATUS AND METHOD FOR ASSEMBLING SUCH A RACK

[75] Inventors: David E. Wenschhof, Victor; Fred M. Fuss, Hamlin; Judith B. Scott, Rochester, all of N.Y.

[73] Assignee: Eastman Kodak Company, Rochester, N.Y.

[21] Appl. No.: 918,339

[22] Filed: Jul. 21, 1992

[51] Int. Cl.[5] ..... B65D 85/672

[52] U.S. Cl. ..... 211/13; 211/41; 206/394

[58] Field of Search ..... 211/13, 40, 41; 206/445, 391, 394, 303; 242/58.6, 79

[56] References Cited

U.S. PATENT DOCUMENTS

| | | | |
|---|---|---|---|
| 4,252,258 | 2/1981 | Plummer | 206/394 |
| 4,392,912 | 7/1983 | Horsley | 242/58.6 |
| 4,620,652 | 11/1986 | Hanlon | 206/394 |
| 5,022,598 | 6/1991 | Hutzenlaub et al. | 242/586 |
| 5,022,807 | 6/1991 | Linder | 242/58.6 |
| 5,193,680 | 3/1993 | Schumann et al. | 242/58.6 |

*Primary Examiner*—Mark Rosenbaum
*Assistant Examiner*—Erik R. Puknys
*Attorney, Agent, or Firm*—Charles E. Snee, III

[57] ABSTRACT

A rack for supporting and accurately positioning rolls of web material (16–24) comprises a base member (10) having an upper surface (12) on which a plurality of support members (14, 26–32) are mounted by a plurality of individually removable brackets (34–40), the support members engaging axially extending ends (24) of the cores (18) of the rolls. A fixture (48–72, 88, 90) and method for assembling such a rack are described.

6 Claims, 8 Drawing Sheets

Fig. 1
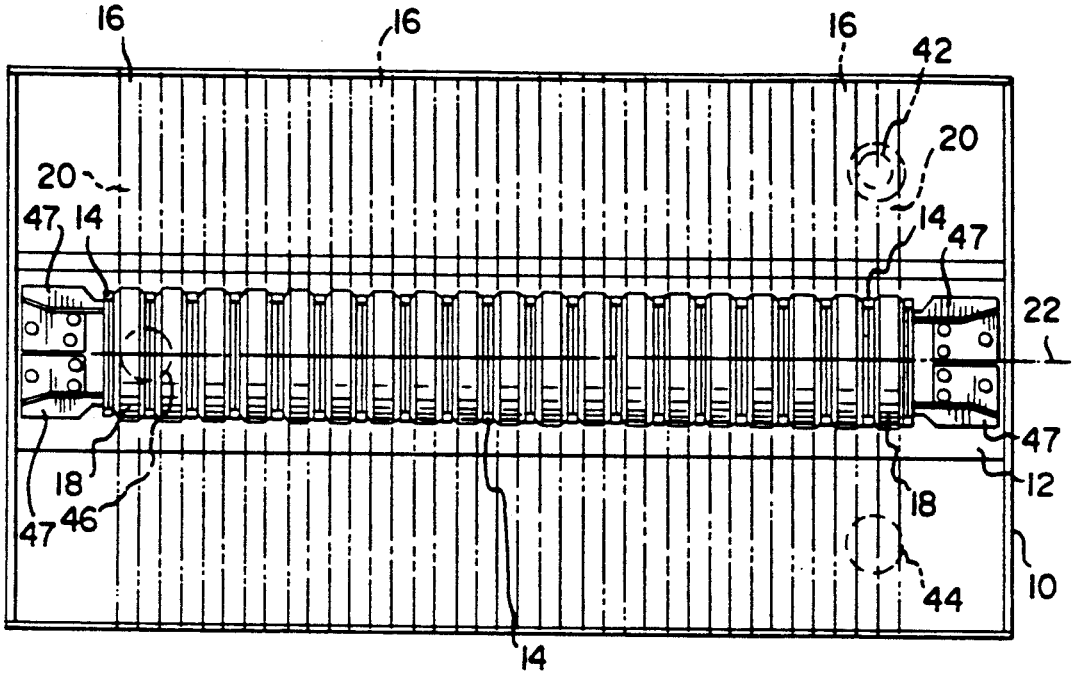
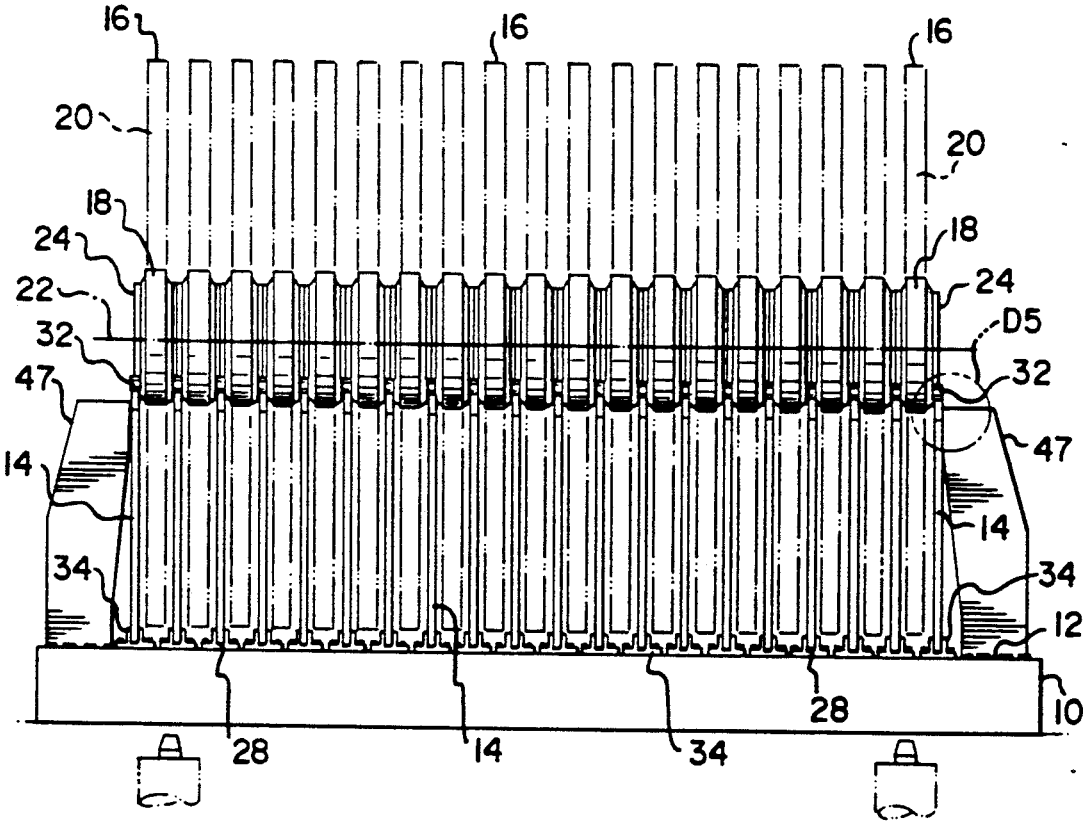
Fig. 2

RACK FOR SUPPORTING ROLLS OF WEB MATERIAL PLUS APPARATUS AND METHOD FOR ASSEMBLING SUCH A RACK

TECHNICAL FIELD

The invention concerns racks for supporting objects in precise locations for removal by automated equipment and apparatus and methods for assembling such racks. More particularly, the invention concerns such racks for supporting a plurality of rolls of web material, such as photographic film; so that the racks can be loaded, moved to a location for processing the web material and precisely located for removal of the rolls by means such as a general purpose programmable robot.

BACKGROUND ART

Various apparatus are known for storing and dispensing lengths of material from reels or spools. For example, U.S. Pat. No. 2,841,343 shows a fixed stand for displaying and dispensing various types of tubing which are mounted on individual shafts inserted through a bore in the reel on which the tubing is wound. U.S. Pat. No. 3,897,914 shows an apparatus for unreeling wire rope from a plurality of reels mounted on pallets individually positioned in robust fixed framework.

Apparatus of the types shown in these patents are not suitable for handling rather large rolls of delicate web material such as 35 mm photographic film. Such rolls may comprise a length of film of several thousand feet and must be handled with care to prevent the convolutions of the roll from shifting axially and to avoid contact of the roll with objects which might damage the film. Because of these concerns, such rolls commonly are transported in individual containers to various processing apparatus, such as perforators and spoolers, where the rolls are manually removed from their containers and loaded onto and removed from the processing apparatus. To ease the burden on the persons handling such rolls, the weight of the rolls is controlled by limiting the length of the film. While such limits are considered necessary for manual handling to avoid injuries to workers as well as damage to the film, the throughput to the processing apparatus is hampered severely by the requirement to use small rolls. Thus, robotic handling systems have been developed to eliminate the job of manual handling and to permit the use of far larger rolls, such as that shown in commonly assigned U.S. application Ser. No. 847,154 filed Mar. 5, 1992. For such robotic handling systems to function best, a need exists for a rack on which such larger rolls can be precisely positioned and which itself can be precisely located for loading and unloading by the robotic handling system. A need also exists for such a rack which can be accurately assembled and which, if damaged, can be readily and accurately repaired.

SUMMARY OF THE INVENTION

The improved rack according to the invention is especially suited for supporting rolls of web material of the type comprising a core on which a length of web material is wound, the core having an axis and opposite ends which extend axially beyond the material. However, the rack is useful for supporting a plurality of objects, each having an axis and opposite ends located on the axis, each of the ends having a portion extending axially beyond the body of the object. The rack may comprise a base member having an upper surface; a plurality of support members, one more in number than the plurality of objects such as rolls, each support member having an upper end and a lower end, each upper end comprising means for supporting one of the ends of one of the objects or for supporting one of the ends of each of an adjacent pair of the objects, with the axes of the plurality of objects colinear. A plurality of means, individually removably mounted on the upper surface, are provided for individually mounting the lower ends to the base member and thereby positioning the plurality of support members to support the plurality of objects. To facilitate use of the rack in an automatic handling system, for example, means may be provided on the base member for locating the rack relative to an underlying support such as a conveyor or work station pallet or the like. In a preferred embodiment of the rack, each of the lower ends comprises an elongated edge; and each of the plurality of means for individually mounting comprises an elongated bracket having an upwardly open elongated channel within which the elongated edge is positioned. The elongated edge is secured within the channel by a layer of hardened adhesive on each side of and beneath the elongated edge. The adhesive may be applied easily since each elongated bracket preferably comprises a groove extended along the open elongated channel to facilitate injecting the adhesive beneath the elongated edge. The means for supporting preferably comprises an upwardly open cradle at the upper end for partially surrounding the ends of the object and means associated with the cradle for contacting and supporting the ends of the objects at least at two circumferentially spaced locations below the colinear axes of the objects. The means for contacting and supporting may comprise a pair of substantially flat surfaced contact pads affixed to the cradle.

The fixture according to the invention for use in assembling such a rack may comprise a platform for supporting the base member, an elongated jig having an exterior geometry simulating the geometry of the colinear objects where the objects are contacted by the means for supporting; means for positioning the elongated jig above the platform; and means mounted to the platform for raising the base member to a position in which the means for supporting engage the elongated jig. To fix the support members while their lower ends are attached to the base member, means may be provided for securing each support member to the elongated jig.

The method according to the invention for assembling such a rack may comprise the steps of providing a platform for supporting the base member; providing an elongated jig having an exterior geometry simulating the geometry of the colinear objects where the objects are contacted by the means for supporting; positioning the elongated jig above the platform; raising the base member to a position in which the means for supporting engage the elongated jig; andadhesively securing the lower ends to the base member. Preferably, each support member is secured temporarily to the elongated jig before adhesively securing the lower ends.

BRIEF DESCRIPTION OF THE DRAWINGS

FIG. 1 shows a top view of a rack according to the invention, with the web material shown in phantom around the cores of the rolls.

FIG. 2 shows a front elevation view of the rack of FIG. 1, also indicating schematically the rack positioning members which may be engaged with the underside of the base of the rack.

DESCRIPTION OF THE PREFERRED EMBODIMENTS

Figure 3:
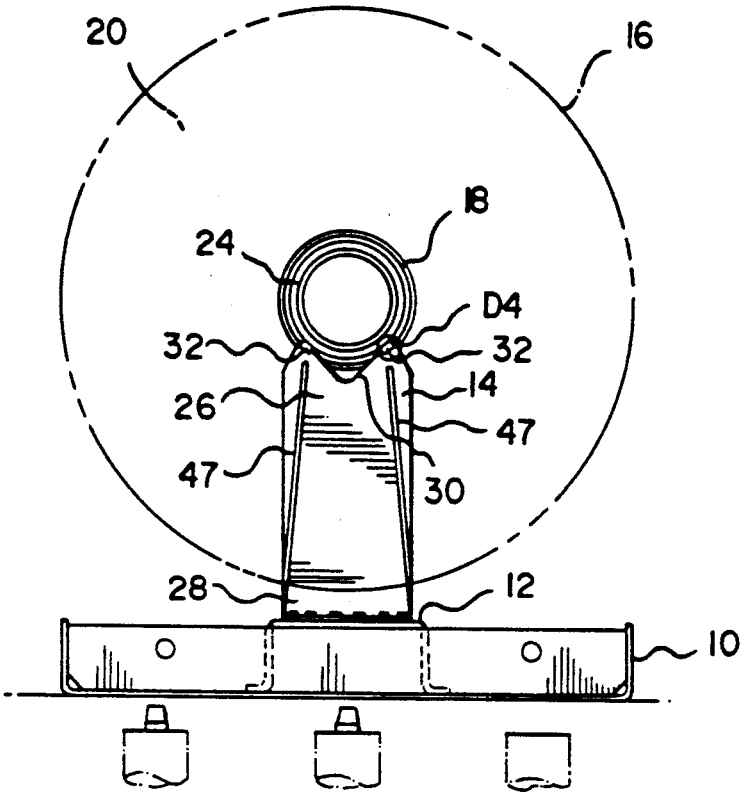
FIG. 3 shows an end view of the rack of FIGS. 1 and 2, as seen from the left of FIG. 2.

The following is a detailed description of the preferred embodiments of the invention, reference being made to the drawings in which the same reference numerals identify the same elements of structure in each of the several Figures.

Figure 4:
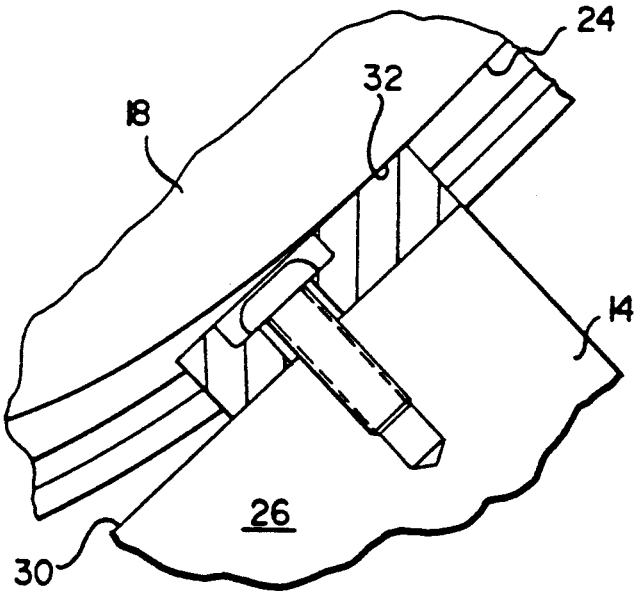
FIG. 4 shows an enlarged fragmentary view, partially in section, of the rack of FIGS. 1 to 3, as indicated at D4 in FIG. 3.
Figure 5:
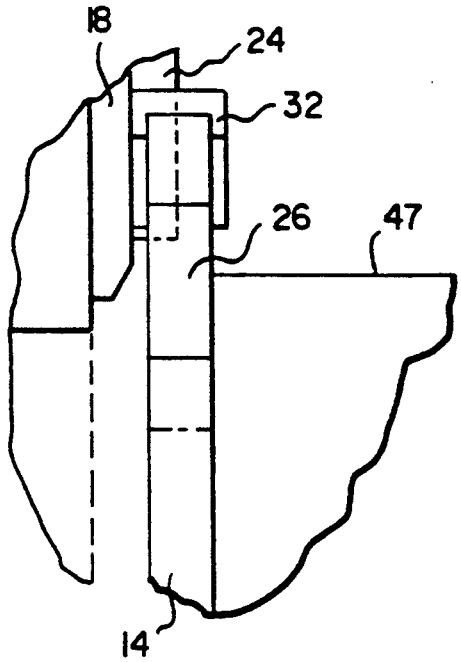
FIG. 5 shows a view from the right of the structure of FIG. 4, indicating the end geometry of the core of a roll of film, as indicated at D5 in FIG. 2.
Figure 6:
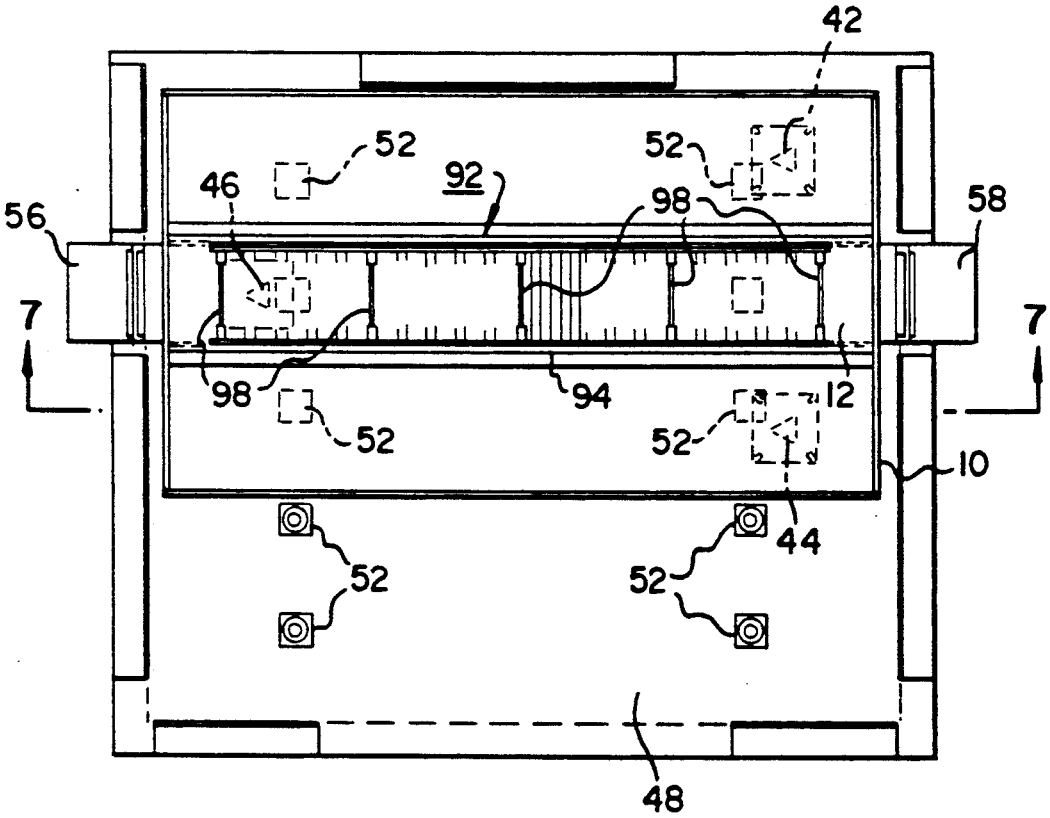
FIG. 6 shows a top view of a fixture according to the invention for assembling the rack of FIGS. 1 to 5, with a rack in place during assembly.
Figure 7:
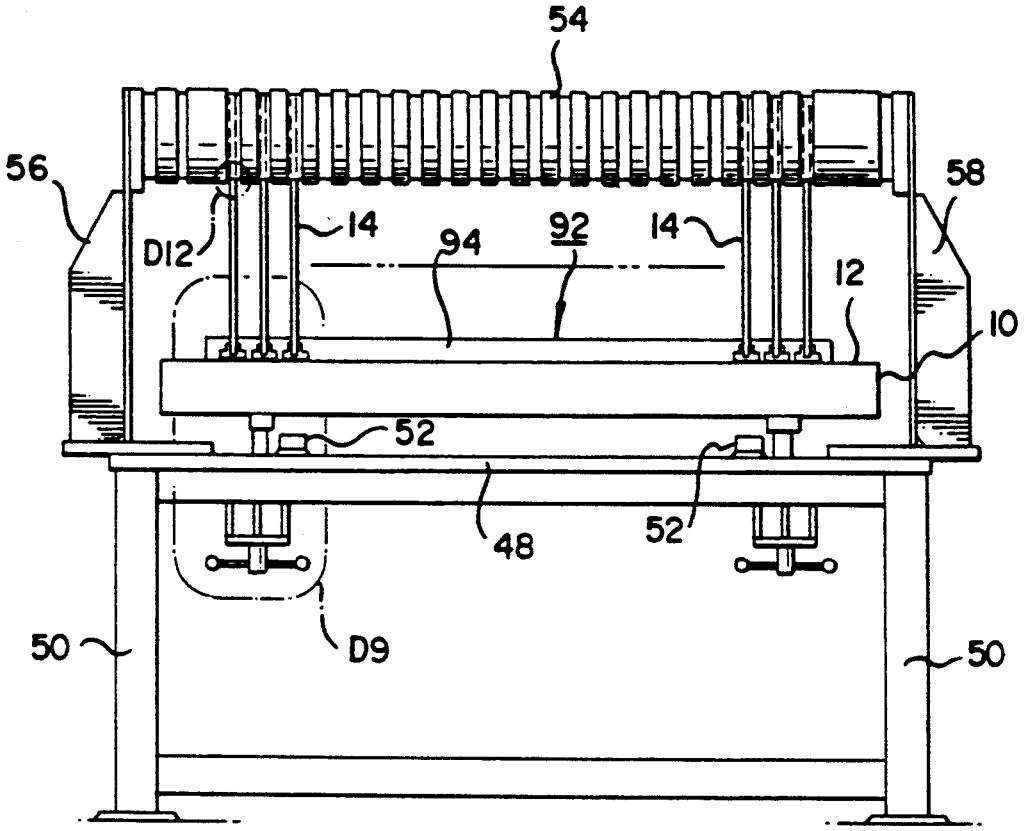
FIG. 7 shows a front elevation view of the fixture and rack of FIG. 6, taken along line 7—7 in FIG. 6.
Figure 8:
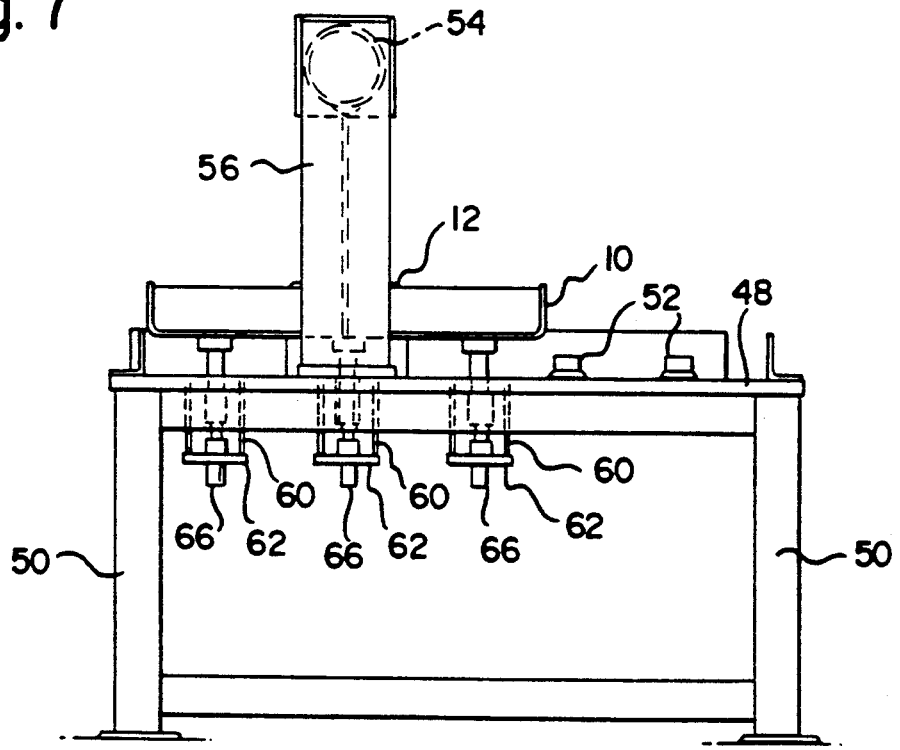
FIG. 8 shows an end view of the fixture and rack of FIGS. 6 and 7, as seen from the left of FIG. 7.
Figure 9:
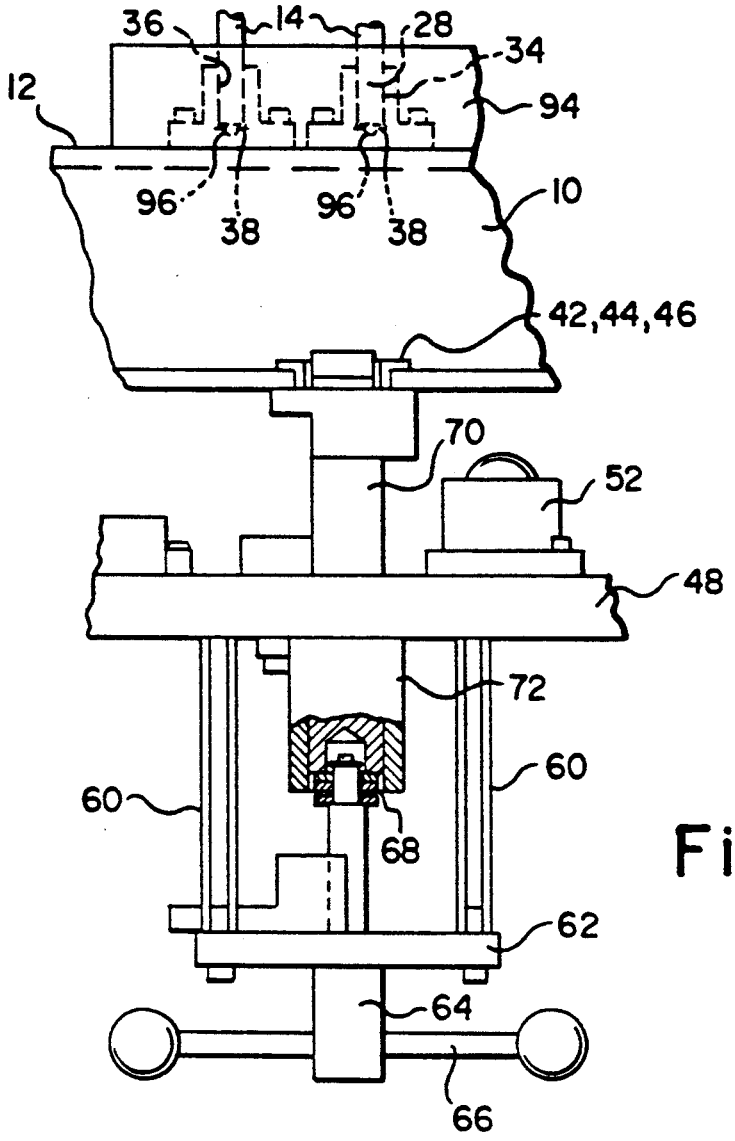
FIG. 9 shows an enlarged fragmentary view, partially in section, of one of the jack screw assemblies used to raise the rack during assembly, as indicated at D9 in FIG. 7.

As shown in FIGS. 1 to 3, the rack according to the invention comprises a generally rectangular base member 10 having an elevated central portion with an upper surface 12. Mounted on surface 12 and extended essentially vertically upwardly are a plurality of support members 14 which may be made from a suitable material such as aluminum plate stock, there being one more of support members 14 than the plurality of rolls 16 to be supported. Each roll 16 comprises a central core 18 which typically is hollow and about which is wound a length 20 of web material, as shown in phantom. Cores 18 are positioned by support members 14 on a common or colinear axis 22, each core 18 having opposite ends 24 which extend axially beyond the web material and which are engaged by the upper ends 26 of support members 14. Upper ends 26 are configured to provide an upwardly open cradle 30 as a means for supporting ends 24 of two adjacent cores 18 or, at the ends of the rack, for supporting a single end 24. Cradle 30 partially surrounds the lower portion of ends 24 below axis 22 and is provided with a pair of circumferentially spaced contact pads 32 having essentially flat surfaces which engage ends 24 tangentially as shown in FIGS. 4 and 5. As seen in phantom in FIG. 9, at their lower ends 28, support members 14 are individually, removably mounted on surface 12 by means of a corresponding plurality of elongated brackets 34 having upwardly open elongated channels 36 which receive the elongated edges of lower ends 28. A layer 38 of adhesive, such as a conventional epoxy cement, is provided between each lower end 28 and channel 36 to secure the lower ends within the channels. To facilitate the application of adhesive layer 38, each channel 36 is provided with a groove 40 in its bottom surface. Means are provided on the underside of base member 10 for locating the rack relative to an underlying support such as a conveyor or pallet. Such means preferably comprises a triangular array 42, 44, 46 of features such as pilot bores or pockets for locator pins or pads, as will be familiar to those skilled in the art. Finally, reinforcement brackets 47 may be provided at both ends of the rack to protect the outermost support members from damage during handling.

As shown in FIGS. 6 to 14, a fixture according to the invention is used for assembling the rack of FIGS. 1 to 5. A platform or table 48 is suitably supported on legs 50 to provide a level working surface on which parallel rows of roller ball units 52 are mounted for supporting base member 10. An elongated jig 54, which is accurately machined to have an exterior geometry simulating the geometry of a row of colinear cores 18 at least where ends 24 are engaged by contact pads 32, is supported above and parallel to table 48 on suitable support brackets 56, 58. Preferably, jig 54 is machine turned from a tube or bar of a suitable material such as aluminum. As shown in detail in FIG. 9, beneath table 48, at each of three locations corresponding to those of array 42, 44, 46, are mounted a plurality of standoff legs 60 which support a jack screw plate 62 on which a vertically oriented jack screw assembly 64 is mounted. A handle 66 is used to rotate the jack screw which extends upwardly to a thrust bearing 68 operatively connected to a locating and lifting member 70 configured at its upper end to mate with one of array 42, 44, 46. Member 70 is guided in its movement by a bushing 72 mounted on the underside of platform 48. Thus, after base member 10 has been positioned on roller ball units 52, jack screw assemblies 64 can be rotated to move members 70 into engagement with array 42, 44, 46, thereby accurately positioning base member 10 relative to jig 54. Further rotation of the jack screw assemblies will raise base member 10 toward jig 54 for a purpose to be described in the following paragraphs.

Figure 10:
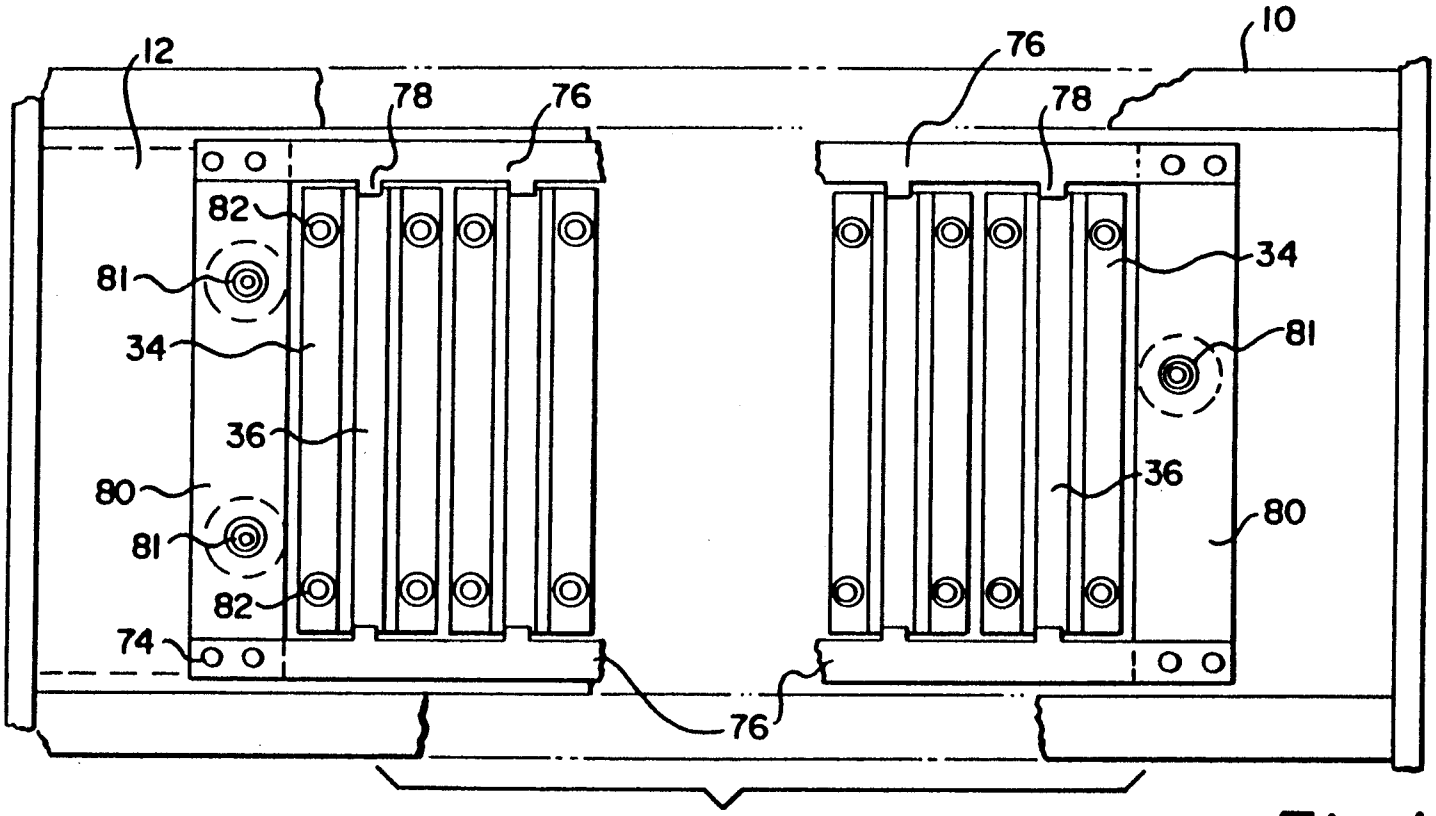
FIG. 10 shows an enlarged plan view of a portion of a rack, indicating the fixture used to align the elongated brackets for the support members.
Figure 11:
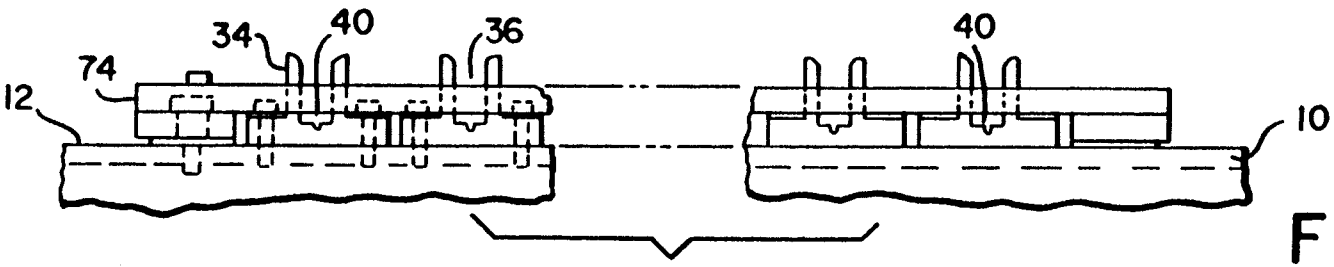
FIG. 11 shows a side view of the apparatus of FIG. 10.

Before or after base member 10 is positioned on platform 48, brackets 34 must be precisely positioned on upper surface 12. For this purpose, the fixture 74 shown in FIGS. 10 and 11 is provided. A pair of side rails 76 are provided with locator tabs 78 for engaging one wall of channel 36 to precisely position brackets 34. Side rails 76 are joined by end rails 80 to provide a frame-like fixture within which all of brackets 34 can be aligned. End rails 80 are precisely positioned on upper surface 12 by suitable fasteners 81 and brackets 34 are butted against one side of their respective locator tabs 78. Brackets 34 are then secured by suitable fasteners 82, so that channels 36 extend essentially horizontal and perpendicular to the projected axis of fixture 54.

Figure 12:
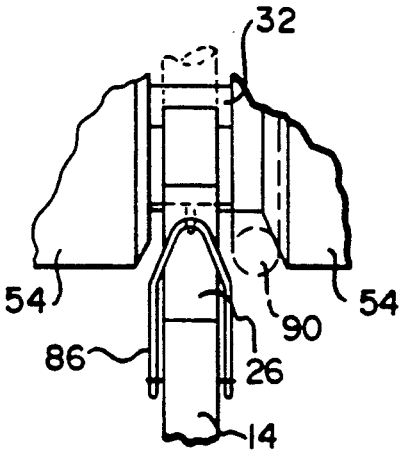
FIG. 12 shows an enlarged fragmentary view of the upper end of one support for a roll as engaged with the jig for positioning the upper ends, as indicated at D12 in FIG. 7.
Figure 13:
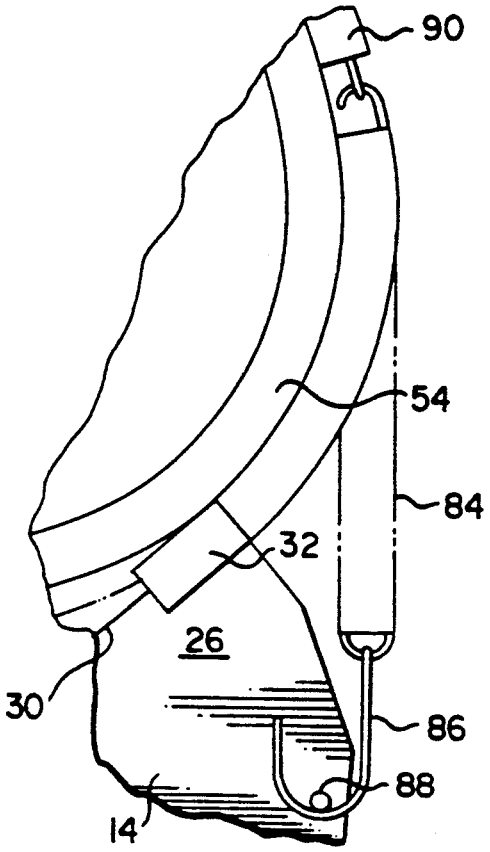
FIG. 13 shows a side view from the left of FIG. 12.
Figure 14:
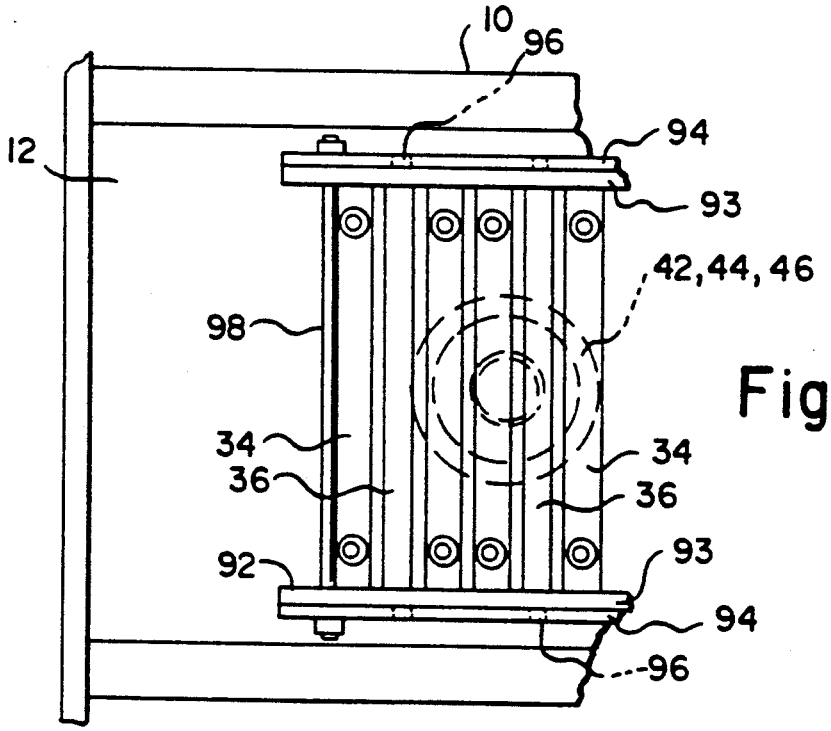
FIG. 14 shows an enlarged fragmentary plan view of one end of a rack, indicating the fixture used for applying adhesive between the lower ends of the supports for the rolls and the bottom brackets and also showing in phantom the locating feature of FIG. 9.

With brackets 34 properly installed, lower ends 28 of support members 14 are slipped into channels 36 while base member 10 rests on roller ball units 52 and is accurately positioned by members 70. In this position of the fixture, cradle 30 and contact pads 32 only loosely engage jig 54. To evenly position lower ends 28 within channels 36, shims may be inserted on either side of the lower ends near the center of the channels. Jack screw assemblies 64 are then actuated to raise base member 10 vertically into exact relationship with jig 54. At this point, an elongated coil or lift spring 84 is wrapped around jig 54 and its end hooks 86 are engaged with pins 88 provided just below each contact pad 32, as shown in FIGS. 12 and 13. The tension on spring 84 pulls contact pads 32 slightly upward and into tangential contact with jig 54, thereby lifting lower ends 28 just above the bottom of channels 36 to permit application of adhesive layer 38. To properly position upper end 26 laterally along jig 54, a pitch spring 90 also may be wound around jig 54, as shown in FIGS. 12 and 13. Hooks on the ends of each pitch spring are engaged with each other to hold the spring in place. At this point, the upper and lower ends of support members 14 are accurately positioned relative to the rest of the rack components.

To facilitate application of adhesive layer 38, a fixture 92 is provided as shown in FIGS. 6, 7, 9 and 14. A pair of side plates 94 extend along the ends of brackets 34 and are provided with transverse holes 96 which are aligned with grooves 40 in each bracket. Compliant pads 93 are clamped between brackets 34 and side plates 94 by a plurality of threaded clamp rods 98. Pads 93 are made from an elastomeric material to which epoxy cement will not stick. Once fixture 92 has been properly positioned, epoxy cement is injected through holes 96 and pads 93 into channels 36 and grooves 40; so that, a layer of adhesive is on each side of and beneath the elongated edges of lower ends 28. After the cement has set, springs 84 and 90 are removed and jack screw assemblies 64 are actuated to lower the completed rack onto roller ball units 52 for removal. Fixture 92 is removed. In the event that a particular support member should be damaged, it can be removed by loosening fasteners 82 and then replaced by following the same process, all the while without disturbing the remaining support members.

Figure 15:
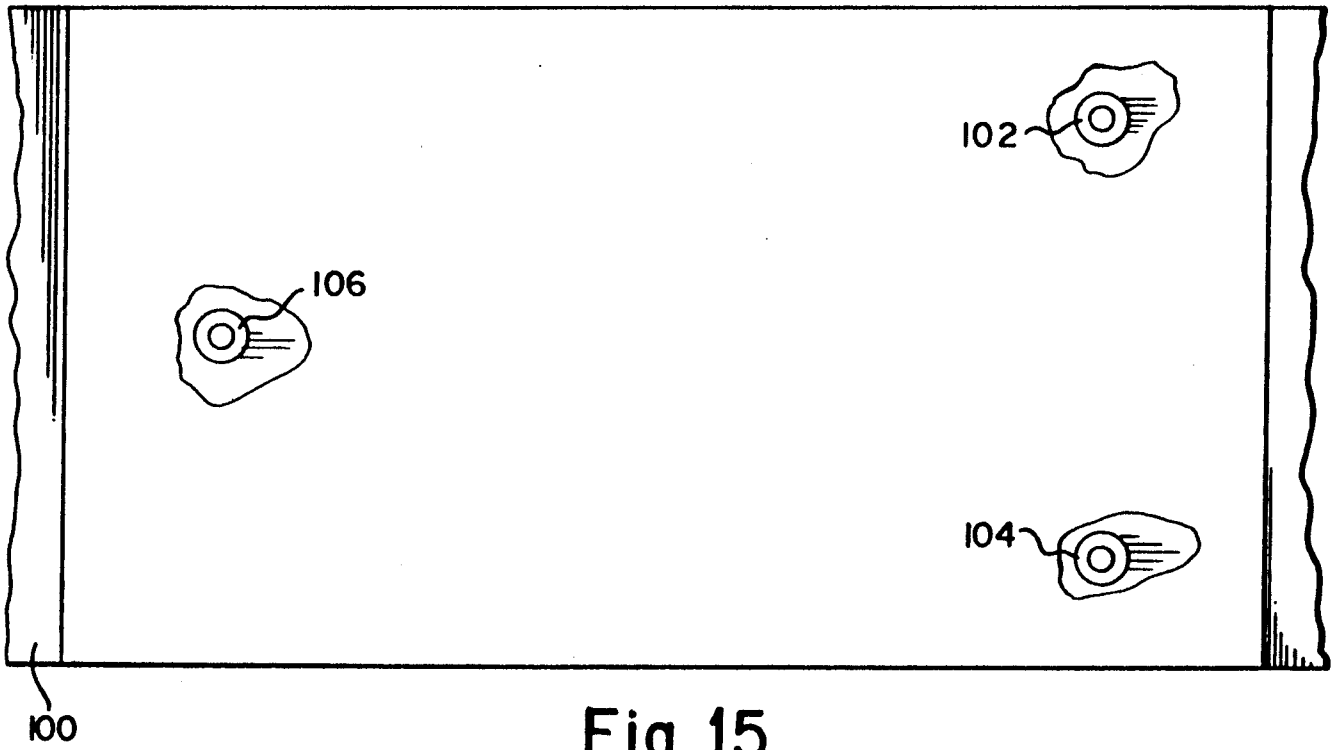
FIG. 15 shows a schematic plan view of the fixtures on a conveyor or pallet which accurately position the rack during use.
Figure 16:
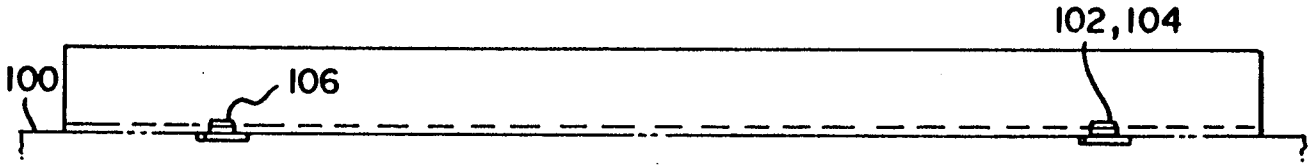
FIG. 16 shows an elevation view of the structure of FIG. 15.

FIGS. 15 and 16 show schematically a portion of a conveyor or pallet 100 having a triangular array 102, 104, 106 of locator features configured to mate with array 42, 44, 46 on the underside of base member 10. Thus, the rack according to our invention can be accurately assembled to support cores 18 in precisely known positions on the rack; and, due to cooperation of arrays 42, 44, 46 and 102, 104, 106, the rack itself can be precisely positioned to permit rolls of web material on such cores or empty cores to be accurately and repeatably placed on and removed from the rack by automated equipment such as a programmable robot.

While our invention has been shown and described with reference to particular embodiments thereof, those skilled in the art will understand that other variations in form and detail may be made without departing from the scope and spirit of our invention.

Having thus described our invention in sufficient detail to enable those skilled in the art to make and use it, we claim as new and desire to secure Letters Patent for:

1. An improved rack for supporting a plurality of objects, each of said objects having an axis and opposite ends located on said axis, each of said ends having a portion extending axially beyond the body of said object, said rack comprising:

a base member having an upper surface;

a plurality of support members, one more in number than said plurality of objects, each support member having an upper end and a lower end, each said upper end comprising means for supporting one of said ends of one of said objects or for supporting one of said ends of each of an adjacent pair of said objects, with said axes of said plurality of objects colinear; and a plurality of means, individually removably mounted on said upper surface, for individually mounting said lower ends to said base member and thereby positioning said plurality of support members to support said plurality of objects.

2. An improved rack according to claim 1, further comprising means on said base member for locating said rack relative to an underlying support.

3. An improved rack according to claim 1, wherein each said elongated bracket comprises a groove extended along said open elongated channel to facilitate injecting said adhesive beneath said elongated edge.

4. An improved rack according to claim 1, wherein said means for supporting comprises an upwardly open cradle at said upper end for partially surrounding said ends and means associated with said cradle for xontacting and supporting said ends of said objects at least at two circumferentially spaced locations, said locations being below said colinear axes.

5. An improved rack according to claim 4, wherein said means for contacting and supporting comprises a pair of sunstantially flat surfaced contact pads affixed to said cradle.

6. An improved rack according to claim 1, wherein each of said objects is a roll of web material of the type comprising a core on which a length of said web material is wound, said core having an axis and opposite ends, each end extending axially beyond said material.

* * * * *

UNITED STATES PATENT AND TRADEMARK OFFICE

CERTIFICATE OF CORRECTION

PATENT NO. : 5,269,415

DATED : December 14, 1993

INVENTOR(S) : David E. Wenschhof, et al

It is certified that error appears in the above-indentified patent and that said Letters Patent is hereby corrected as shown below:

Column 6, Line 22, should read -- having an upper end and a lower end, each said lower end comprising an elongated edge, each said --

Column 6, Line 32, should read -- support said plurality of objects, each of said plurality of means for individually mounting comprises an elongated bracket having an upwardly open elongated channel within which said elongated edge is positioned and a layer of hardened adhesive on each side of and beneath said elongated edge within said channel. --

Signed and Sealed this

Eighth Day of August, 1995

Bruce Lehman

*Attest:*

BRUCE LEHMAN

*Attesting Officer*

*Commissioner of Patents and Trademarks*